US005377787A

United States Patent [19]

Chabrier

[11] Patent Number: 5,377,787

[45] Date of Patent: Jan. 3, 1995

[54] VERTICALLY DISPLACEABLE PLATFORM

[76] Inventor: Philippe Chabrier, Sociera BP 4766, Libreville Gabon, South Africa

[21] Appl. No.: 132,823

[22] Filed: Oct. 7, 1993

[30] Foreign Application Priority Data

Oct. 13, 1992 [FR] France ..... 92 12507

[51] Int. Cl.[6] ..... B66B 17/12

[52] U.S. Cl. ..... 187/404; 187/206; 187/406; 5/10.2; 5/11

[58] Field of Search ..... 187/1 R, 94, 95, 8.41, 187/8.47, 8.49; 5/10.1, 10.2, 11

[56] References Cited

U.S. PATENT DOCUMENTS

| | | | |
|---|---|---|---|
| 866,695 | 9/1907 | Taussig | 5/11 X |
| 983,957 | 2/1911 | Trantham | 5/10.2 X |
| 1,057,719 | 4/1913 | Farnsworth | 5/11 |
| 1,065,740 | 6/1913 | Sorlien | 5/10.2 |
| 1,197,035 | 9/1916 | Knudtson et al. | 5/10.2 |
| 2,632,183 | 3/1953 | Patton et al. | 5/10.2 |
| 3,396,822 | 8/1968 | Guilbert, Jr. | 187/1 R X |
| 3,565,217 | 2/1971 | St. Louis | 187/95 X |
| 3,706,356 | 12/1972 | Herbst et al. | 187/8.41 X |
| 3,934,496 | 1/1976 | Turko | 187/94 X |
| 4,715,574 | 12/1987 | Holt et al. | 187/94 X |

FOREIGN PATENT DOCUMENTS

| | | | |
|---|---|---|---|
| 418415A1 | 3/1991 | European Pat. Off. | 5/11 X |
| 2616309 | 12/1988 | France . | |
| 2633814 | 1/1990 | France . | |
| 2643244 | 8/1990 | France . | |
| 1949545 | 7/1970 | Germany . | |
| 3233569 | 3/1984 | Germany . | |
| 1321281 | 12/1989 | Japan | 187/1 R X |
| WO92/05728 | 4/1992 | WIPO . | |

*Primary Examiner*—Robert P. Olszewski
*Assistant Examiner*—Dean A. Reichard
*Attorney, Agent, or Firm*—Young & Thompson

[57] ABSTRACT

A platform (1) comprising a fixed structure (2) and a plate (3) movable in translation comprising four corners (4). Each corner (4) of the plate is secured to a vertical translation structure (5) which ends in a counterweight (6). A fixed structure comprises three guideposts (7, 14, 21) which coact with three translation structures (5). A support arm (9) is disposed in the upper portion of the platform (1) which coacts with the fourth translation structure (5). In this way, a fourth guidepost is avoided, so that ready access is provided to the space below the plate. At the same time, the plate is supported at all four corners and so is securely arranged.

6 Claims, 4 Drawing Sheets

VERTICALLY DISPLACEABLE PLATFORM

FIELD OF THE INVENTION

The present invention relates to a vertically displaceable platform.

More particularly, the platform serves as a mezzanine when it is in lowered position and can be disposed against the ceiling in its upper position, so as to free to the maximum the space below the latter.

THE KNOWN PRIOR ART

Numerous references already relate to such devices.

WO 92/05728 relates to a platform which comprises a fixed structure and a platform movable vertically by means of a raising device adapted to maintain it in horizontal equilibrium in the course of these movements. It is characterized in that the fixed structure is comprised by two vertical frames perpendicular to each other, within the angle of which is horizontally inscribed a corresponding triangular portion of the movable platform prolonged outwardly of said angle by an overhanging portion, said portions of the plate being located on opposite sides of a radial beam of the plate between two raising points of the plate located at a spacing from the center of gravity of this latter, and adjacent two vertical guide beams disposed respectively at the free ends of the frames of the structure, such that the service of the ground corresponding to the projection of the plate will be free of all obstacles within the angular field of said frames.

FR-A-2.643.244 relates to a device permitting the displacement of a bed vertically and parallel to itself within a carrying structure resting on the ground. The bed is movable between a lower use position in which it rests on bearing points fixed to the structure and a high storage position. Four cords fixed to four points of the bed are directed by pulleys to a gripping member carried by a hoisting gear. The displacement of the bed can be achieved by pulling on a single cord.

FR-A-2.633.814 relates to a retractable bed system for small rooms. This system comprises means such as suspension cables and pulleys permitting raising the bed to the horizontal toward the ceiling of the room when it is not used and lowering it to a suitable height in use position.

FR-A-2.616.309 relates to a mezzanine platform comprising a horizontal plate which the user can displace manually from a lower temporary use position, for example for sleeping, to a raised position freeing the surface of the floor to a height permitting standing up. The displacement of the plate is permitted by the use of a counterweight, of a weight equivalent to that of the plate and variable as a function of the load of the latter. The plate moves within a fixed structure comprising at least two beams or rails adapted to guide it and to ensure safety in use. Sliding is ensured by the interposition, between the plate and the beams or rails, of rollers or slideways mounted on a resilient device.

DE-A-3.233.569 relates to furniture which combines a bed and a table, the table being in lower position and the bed in upper position, within a frame on which are located hoisting means permitting the lowering and raising of said bed relative to four posts.

Finally, DE-A-1.949.545 relates to a bed device having one or several plates which can be displaced along two tracks located in two vertical posts, the weight of the bed being counterbalanced by a counterweight.

Thus, when the bed or beds are not utilized, it or they can be raised toward the ceiling.

Most of these references describe mezzanine beds which are guided in their vertical displacement by four posts.

This arrangement, although it permits the freeing of the space below the mezzanine bed, does not permit eliminating the fourth post, which is located in the middle of the member, which is not true for the other three posts, which are disposed against the walls of the room.

So as no longer to be inconvenienced by this fourth post, certain devices propose simply eliminating this post, which limits the posts to three.

In still other cases, the post opposite the one that was previously omitted, does not serve for guiding the platform, which limits the guideposts to two.

It is easy to understand that these devices create adjacent the angles of the platform, which are no longer supported, overhangs, which is unfavorable for good operation of these devices.

So that there will be no overhang in the lower position, support means, such as for example small stools are provided.

Nevertheless, the problem of overhang persists during movements or the upper position of the platform, especially if this latter is loaded.

Finally, the use of support means renders very difficult a higher or lower adjustment of the platform in the lower position, because said support means have to be adapted to these modifications.

SUMMARY OF THE INVENTION

The present invention overcomes these problems, by using a platform for use as a mezzanine or other like use, comprising a fixed structure and a platform movable in translation comprising four corners, each corner of said platform being fixed to a vertical translation means which ends in a counterweight, characterized by the fact that the fixed structure comprises three guideposts which coact with three translation means, and a support arm disposed in the upper portion of the platform which coacts with the fourth translation means.

The invention therefore has for its essential object to provide a platform system which uses three posts, so as to free totally the underside of the plate of said platform, but which, so as to ensure maximum safety, uses four raising and lower means disposed at the four corners of said plate.

The platform is also characterized by the fact that two of the guideposts are disposed against two adjacent side walls forming the room, and that the third post is disposed within the corner formed by the two said side walls.

The support arm is one of the essential elements of the invention, and can have different shapes of which two are more particularly described in the following text.

Thus, the support arm can be constituted by a rod one of whose ends is fixed to the top of the guidepost which is located in the corner of the room, the free end being situated directly above the corner of the movable plate which does not coact with one of the guideposts, said rod being supported by another rigid bar, whose two ends are fixed to the tops of the two other guideposts.

The support arm can also be constituted by two tubes each having one of its two ends fixed to the top of one of the two guideposts, while the two other ends of the tubes are connected to each other, and their intersection point is located directly above the corner of the movable plate which does not coact with one of the guideposts.

The platform is also characterized by the fact that each guidepost disposed against a wall face is connected to the corner guidepost by an upper elongated member and by a lower elongated member.

BRIEF DESCRIPTION OF THE DRAWINGS

The accompanying drawings are given by way of indicative but non-limiting examples. They show two preferred embodiments of the invention. They permit easy comprehension of the invention.

DETAILED DESCRIPTION OF THE INVENTION

Figure 1:
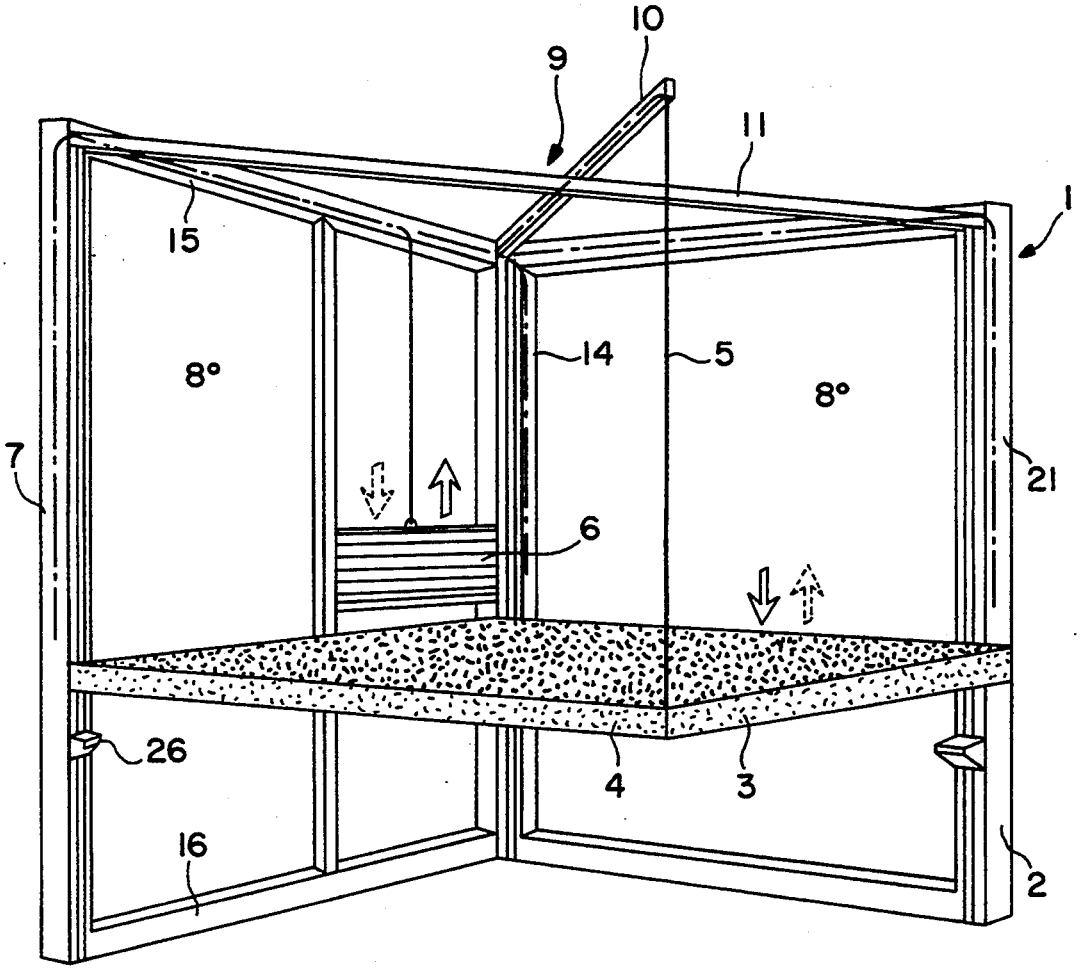
FIG. 1 is a perspective view of a preferred embodiment of the present invention.

According to FIG. 1, the platform 1 is comprised by two essential parts.

A first part is the fixed structure 2, and is formed by two guideposts 7, 21 which are located against two adjacent side walls 8 of a room. It is also formed by a guidepost 14 positioned in the corner of the room formed by the two adjacent side walls 8 and two elongated members, an upper one 15 and a lower one 16 along the side of the wall 8, permitting connecting one of the guideposts 7, 21 to the corner guidepost 14.

This fixed structure also comprises a supporting arm 9 which is formed by a rod 10 which is fixed by one of its ends to the upper end of corner guidepost 14, the other end remaining free.

Disposed below the rod 10, so as to support it, is another rigid rod 11 connected by each of its ends to the upper end of a respective one of the guideposts 7, 21.

The guideposts 7, 14 and 21, the upper elongated member 15 as well as the rod 10 are all hollow, so as to provide passage for vertical translation means 5 which are in this case constituted by cables and pulleys.

The two latter elements are shown very sketchably on the drawings so as not to uselessly complicate them with elements which are already well known in the art.

The various cables all lead to the same point, which is in line with a counterweight 6, which is located against one of the side walls 8.

There could also be used, in association or not with a counterweight 6, one or several electric motors, such that the user could actuate the plate 3, to raise it or lower it, with no effort.

Finally, a second part is the movable plate 3 and is of substantially rectangular or square shape.

Because of this, it has four corners 4 which typically can be right angled.

In the same way, the corners can be different or be equal two by two so as to give a quadrilateral shape to the movable plate 3 such that the latter can be adapted to any shape corner of the room.

In any event, the four corners 4 each have a position predetermined by the fixed structure 2.

Three of the corners 4 are adjacent the three guideposts 7, 14 and 21, while the fourth corner 4 is in vertical alignment with the free end of the rod 10 of the support and an arm 9.

Finally, there is disposed at the level of the guideposts 7, 14 and 21, adjustable feet 26 which permit supporting the movable plate 3 in its lower position, especially when it is loaded, for example with a mattress to provide a retractable bed.

Figure 2:
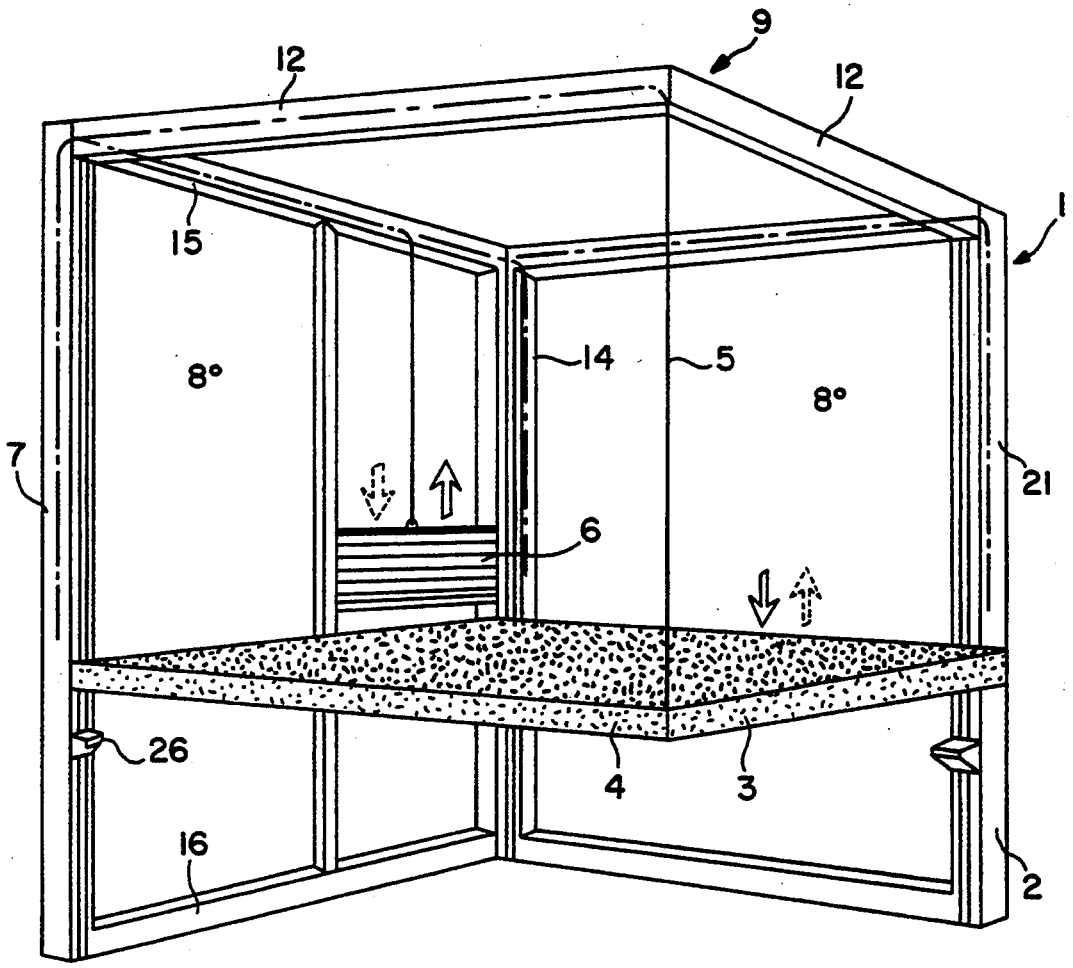
FIG. 2 is a perspective view of another preferred embodiment of the present invention.

FIG. 2 is in all respects similar to the description of FIG. 1.

The single difference of FIG. 2 arises in that the support arm 9 is comprised by two tubes 12.

These two tubes 12 having each one of their two ends fixed to a respective top of one of the guideposts 7 and 21, the other two ends of the tubes 12 are connected to each other.

The point of intersection of the ends of the tubes 12 is located directly above the corner 4 of the movable platform 3 which does not coact with one of the guideposts 7, 14 and 21.

One of these two tubes 12 is hollow so as to permit the passage of translation means 5.

Generally, the tube 12 which receives the translation means 5 is the one secured to guidepost 7 which is disposed against the same side wall 8 that receives the counterweight 6, so as to limit the number of deflections about pulleys (not shown).

It will be quite evident that a plate, not shown in FIGS. 1 and 2, permits hiding the counterweight 6 from the view of the users.

Figure 3:
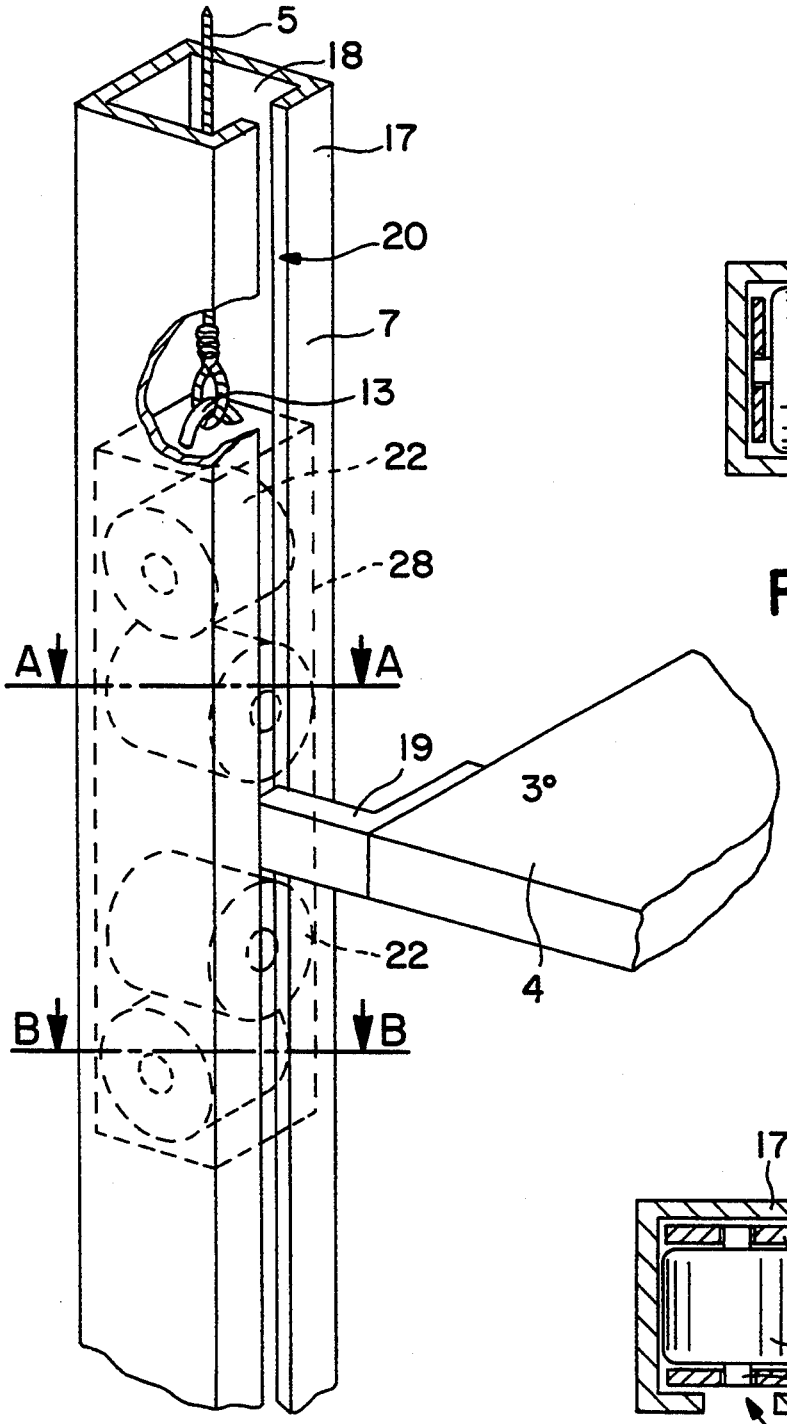
FIG. 3 shows a detail of a guidepost at the level of the movable plate guide.

In FIG. 3, the connection between the fixed structure 2 and the movable plate 3 forming the platform 1 is shown in detail.

The guideposts 7, 14 or 21 are formed of a longitudinal element 17 delimiting a recess 18 to which access can be had through a longitudinal window 20.

Disposed in the interior of the recess 18, and having dimensions slightly less in length and in width than the same, is a guide 28 which can move on four rollers 22.

A connecting member 19 rigidifies the guide 28 to the movable plate 3.

Securement means 13 connects the upper portion of the guide 28 to the vertical translation means 5.

Figure 4:
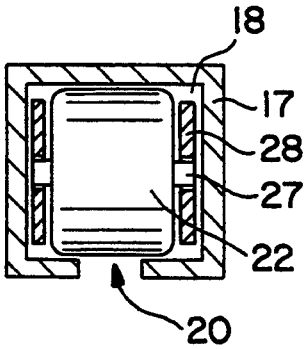
FIG. 4 is a cross section on the line A—A of FIG. 3.
Figure 5:
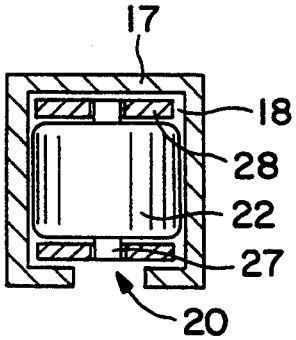
FIG. 5 is a cross section on the line B—B of FIG. 3.

FIGS. 4 and 5 show two cross sections on the axes of the two rollers 22, of different arrangements.

In FIG. 4, the roller 22 has its rolling surface located facing the longitudinal window 20 and facing the opposite surface of the longitudinal element 17.

Against the two other surfaces, the walls of the guide 28 are pierced to let pass the axle 27 of the roller 22.

Of course, at the level of the roller surfaces, the guide 28 is absent such that the said roller surfaces can play their role.

FIG. 5 is exactly the same arrangement except that the axle 27 of the roller 22 is perpendicular to that of FIG. 4.

The recess 18 is substantially filled by the guide 28 and the rollers 22, which permits not having guidance problems.

It is necessary that the diameter of the rollers 22 be greater than the width or the length of the guide 28.

Figure 6:
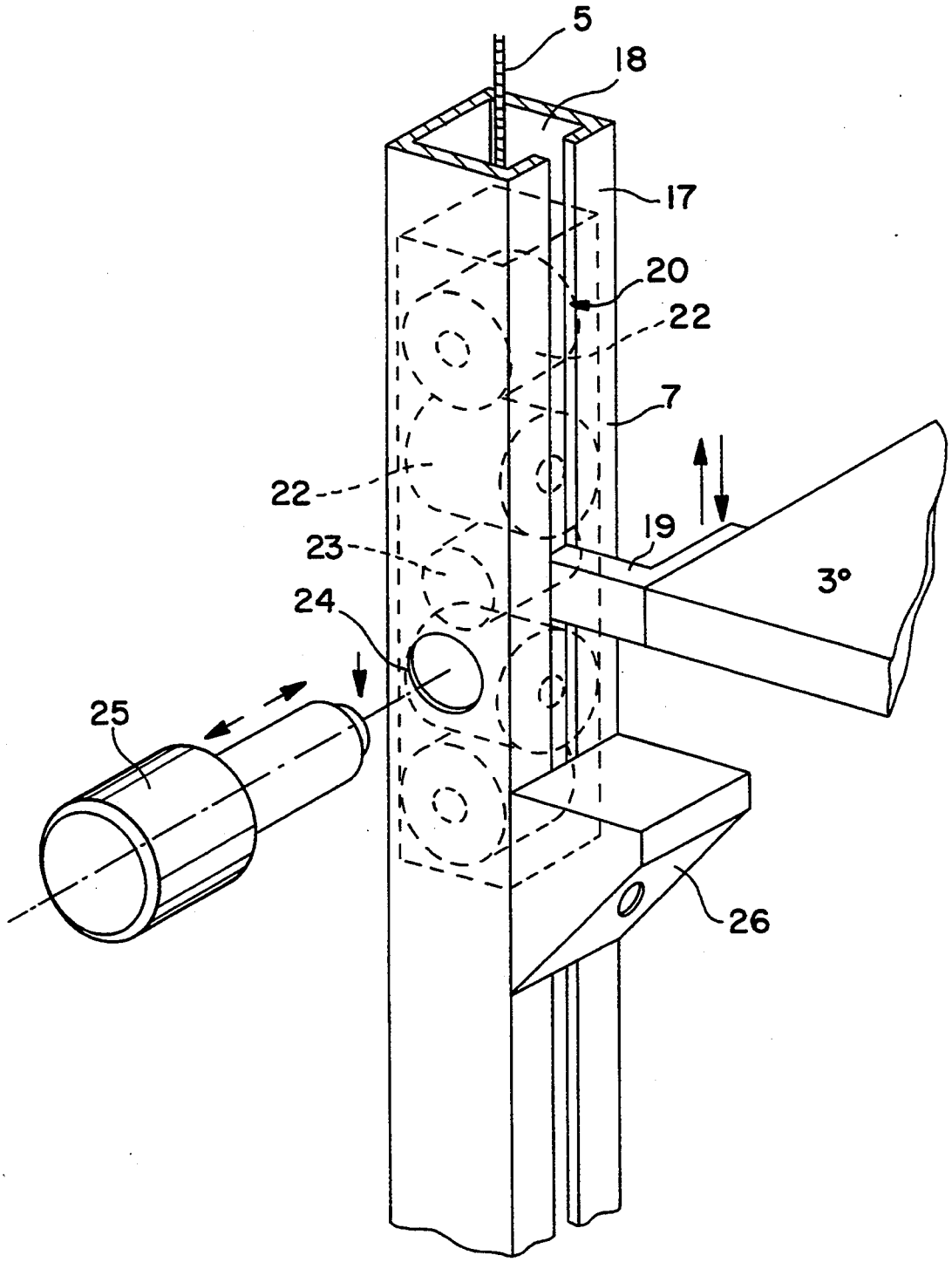
FIG. 6 is a detail of a guidepost at the level of its lower position.

According to FIG. 6, the movable plate 3 is in lowered position.

The foot 26 is present on the guideposts 7, 14 and 21 so as to receive said movable plate 3.

This figure is similar to that of FIG. 3; nevertheless, there has also been shown a system which permits blocking the guides 28 and, as a result, the movable plate, either in lowered position, in case said plate 3 is too light and it cannot rise, or in upper position in the case in which said plate 3 is too heavy and it cannot descend.

To this end, the longitudinal element 17 is traversed from side to side by two holes 24.

Similarly, the guide 28 is apertured from side to side by at least one opening 23.

The holes 24 and the openings 23 can be in confronting relation such that it will be possible to introduce a pin 25 thereinto.

To summarize the discussion given relative to the figures, one of the objects of the present invention is to provide that each post 7, 14, 21 is formed by a longitudinal element 17 having a recess 18 which comprises a longitudinal window 20.

An object of the present invention is also to provide that the recess 18 of each guidepost 7, 14, 21 permits the passage of a guide 28 provided with at least one roller 22.

Still another object of the invention is that each guide 28 is fixed, in its upper portion, to one of the translation means 5 and, in its side portion, to one of the corners 4 of the movable plate 3, facing the window 20 of the longitudinal element 17.

On the other hand, at least one guide 28 is pierced through perpendicularly to its axis by two openings 23.

Similarly, at least one guidepost 7, 14, 21 is pierced through, perpendicularly to its axis, by at least two holes 24, one in lower position and one in upper position, such that when the opening 23 of the guide 28 is located facing one of the holes 28 of the guidepost 7, 14 or 21, a pin 25 can be inserted so that the movable plate 3, in lower position, cannot be raised, or that the movable plate 3, in upper position, cannot be, lowered.

Still another object of the invention is to provide a platform 1 in which at least one guidepost 7, 14 or 21 receives an adjustable foot 26 on which the movable plate 3 comes to rest in lowered position.

Finally, an object of the invention is to provide a platform 1 in which the support element can be constituted by a small ladder or a peg, and can be folded below the movable plate 3, then unfolded toward a vertical position at the level of the corner 4 of said plate 3, which does not coact with one of the guideposts 7, 14 or 21, the support element thus performing the function of a support of the movable plate 3; this support element is not shown in the figures.

The platform 1 according to the invention therefore permits freeing a maximum of space when the plate 3 is raised, thanks to the use of three posts 7, 14 and 21, but it also permits having a greater stability of said plate 3 which is maintained thanks to four vertical translation means 5 secured one to each of its corners 4, and even if desired by a support peg when the movable plate 3 is in lower position.

Removable guards can be placed along the two sides of the movable plate 3 which do not extend along the walls 8, such that it will be impossible for personnel or objects to fall off.

What is claimed is:

1. Vertically displaceable a platform (1) comprising a fixed structure (2) and a plate (3) movable in translation comprising four corners (4), each corner (4) of said plate being secured to a different one of four vertical translation means (5) which end in a counterweight (6), said fixed structure comprising three guideposts (7, 14, 21) which coact with three of said translation means (5), and a support arm (9) supported by an upper portion of the fixed structure (2) and having an end that is disposed directly above the said corner (4) of said plate which is spaced from said three translation means (5), the fourth of said translation means being secured to the last-named corner and being carried by said end of said support arm (9).

2. A platform according to claim 1, wherein said support arm (9) is constituted by a rod (10) having in addition to said end an opposite end fixed to an upper portion of one said guidepost, the first-mentioned end of said support arm (9) being a free end of said support arm (9).

3. A platform according to claim 2, and another rod (11) having two ends fixed respectively to upper portions of the two said guideposts (7, 21) other than said one guidepost (14).

4. A platform according to claim 1, wherein said support arm (9) is constituted by two tubes (12) each having two ends, one of said two ends of each said tube (12) being fixed to an upper portion of one of two of said guide-posts (7, 21), while the two other ends of the tubes (12) are connected to each other at a point of intersection located above said last-named corner (4) of said movable plate.

5. A platform according to claim 1, wherein said guideposts are disposed in two vertical planes perpendicular to each other, said planes intersecting at one of said guideposts (14), upper and lower ends of said guideposts being interconnected by upper and lower elongated horizontal members (15, 16).

6. A platform according to claim 1, wherein each said guidepost (7, 14, 21) is hollow and provides passage for a guide (28) provided with at least one roller (22), at least one said guide (28) being pierced through perpendicularly to a longitudinal axis thereof by at least one opening (23), at least one said guidepost (7, 14, 21) containing said at least one guide (28) being pierced through perpendicularly to a longitudinal axis thereof by at least two holes (24), one corresponding to the upper position of the platform and the other corresponding to the lower position of the platform, such that when the opening (23) of the guide (28) is located facing one of the holes (24) of the guidepost (7, 14, 21), a pin (25) can be inserted such that the plate (3) in lower position cannot rise or that the plate (3) in upper position cannot fall.

* * * * *